US008979356B2

(12) United States Patent
Brown

(10) Patent No.: US 8,979,356 B2
(45) Date of Patent: Mar. 17, 2015

(54) DUAL AGITATOR MIXER WITH SANITARY TANK

(71) Applicant: Kyle A. Brown, Little Falls, NY (US)

(72) Inventor: Kyle A. Brown, Little Falls, NY (US)

(73) Assignee: Feldmeier Equipment, Inc., Syracuse, NY (US)

( * ) Notice: Subject to any disclaimer, the term of this patent is extended or adjusted under 35 U.S.C. 154(b) by 147 days.

(21) Appl. No.: 13/718,433

(22) Filed: Dec. 18, 2012

(65) Prior Publication Data

US 2014/0169120 A1 Jun. 19, 2014

(51) Int. Cl.
*B01F 15/00* (2006.01)
*B01F 7/16* (2006.01)

(52) U.S. Cl.
CPC ..... *B01F 15/00025* (2013.01); *B01F 7/166* (2013.01)
USPC ..... 366/169.1; 366/170.2; 366/170.4

(58) Field of Classification Search
USPC ..... 366/252, 257, 258, 295, 168.1, 169.1, 366/169.2, 170.1, 170.2, 170.3, 170.4, 331, 366/608
See application file for complete search history.

(56) References Cited

U.S. PATENT DOCUMENTS 2,463,886 A 3/1949 Langmyhr
2,864,594 A 12/1958 Martinek
2,905,451 A 9/1959 Callanen et al.
4,136,886 A 1/1979 Sjoholm et al.
4,511,255 A 4/1985 Saucier
4,854,720 A 8/1989 Schold
4,883,363 A * 11/1989 Pillon et al. ..... 366/169.1
5,823,667 A * 10/1998 Fukushima et al. ..... 366/295
6,193,409 B1 2/2001 Brunson et al.
7,112,033 B1 9/2006 Holdorf
7,544,917 B2 6/2009 Sipma et al.
8,109,208 B2 2/2012 Bokelmann et al.
2011/0253182 A1* 10/2011 Isenberg et al. ..... 384/492
2011/0254231 A1 10/2011 Isenberg et al.

* cited by examiner

*Primary Examiner* — Tony G Soohoo
*Assistant Examiner* — Anshu Bhatia
(74) *Attorney, Agent, or Firm* — Bernhard P. Molldrem, Jr.

(57) ABSTRACT

Coaxial, dual agitator top-entering mixer has coaxial vertical drive shafts penetrating the center of the head of the vessel, driving a lower-speed outer scraper agitator and a higher-speed inner agitator. An inner rotary seal closes the upper end of an annular space between the inner and outer shafts. An outer rotary seal closes the opening around the outer drive shaft in the head of the vessel. A central bore along the inner drive shaft axis extends from its upper end down to a position just below the inner seal, with one or more cross-bored radial passages to the annular space between the drive shafts. A rotary fitting at the upper end of the inner drive shaft permits the introduction of a cleaning fluid into the central bore. The cleaning fluid passes through the bore and the radial passage into the annular space to clean accumulations from within the annular space. The cleaning fluid exits the annular space into the interior of vessel. A single-agitator mixer may also employ this through-the-shaft cleaning feature.

12 Claims, 4 Drawing Sheets

DUAL AGITATOR MIXER WITH SANITARY TANK

BACKGROUND OF THE INVENTION

This invention relates to mixers of the type employed in sanitary processing of pharmaceuticals, cosmetics, or other products that are to be kept safe for human use, and is more specifically related to an improvement in dual agitator mixers that permits cleaning in place of all interior surfaces.

Coaxial, dual-agitator and single-agitator mixers are employed in industries such as pharmaceuticals, cosmetics, and food products where the ingredients to be mixed and the resulting product need to be kept sanitary or in some cases sterile.

In practice, these mixers are in the form of a large tank or similar vessel, which may have a capacity from about twenty gallons up to tens of thousands of gallons, usually formed of stainless steel, either with one agitator or with two internal agitators that rotate in opposite directions. Usually these are top-entering mixers, with coaxial vertical drive shafts that penetrate the center of the closed top of the vessel, with a lower-speed outer scraper agitator and a higher-speed inner agitator. The drive shafts are collocated with the axis of the tank or vessel, so that the agitators are centered in the vessel. The two agitators have respective drive shafts, driven by independent gearmotors, which can be electric or hydraulic, with an upper gearmotor driving the inner agitator and the lower gearmotor driving the outer or scraper agitator.

In mixers of this arrangement, the inner drive shaft that drives the inner agitator descends through a hollow outer shaft that drives the outer agitator. The outer shaft ends a short distance below the point where it enters the mixing vessel, with the inner shaft continuing on downward. This arrangement requires that there be two rotary seals: one seal where the outer shaft penetrates the top or head of the vessel, and a second rotary seal where the inner shaft exits the lower end of the hollow outer shaft. This design closes off and seals the hollow annular space between the inner shaft and the outer shaft.

A number of issues arise where the second seal, or annular space seal, resides within the tank or vessel. The inner seal is difficult to clean, especially when using clean-in-place or C.I.P. techniques. The seal may also fail, resulting in pieces of the seal falling into the product. Servicing the seal requires a person to enter the confined space inside the vessel, which leads to safety concerns for the user. In this typical arrangement the inner seal is often three feet or more away from the associated gearmotor, which makes the seal more susceptible to increased shaft run-out, carbon wear, which may contaminate the product, and premature seal failure. Also, any oil leakage from the upper gear motor will tend to run into the annular space where it may escape past the inner seal and enter the product in the vessel.

Where a clean-in-place or C.I.P. system is used to clean and sanitize the vessel and agitators between uses, only the agitators and the outer surfaces of the drive shafts can be exposed to the spray of the C.I.P. fluid, and it has not been possible to spray or flow C.I.P. fluid into the annular space. Even if an inner seal for the annular space is located outside the vessel, there is currently no satisfactory technique for cleaning the annular space and, despite that space being out of direct contact with the product itself, the annular space is continuously exposed to various vapors, and presents a significant cleaning concern.

Traditional C.I.P. cleaning of agitators and seal areas is carried out using in-tank spray devices. Some seals have provisions for flushing (which is not effective cleaning), it would be preferable to have a rotating spray of the C.I.P. fluid sprayed directly onto the seal faces and seal glands. Seal design is an industry concern, especially in terms of efforts to make the seals more sanitary. However, current modes of internal cleaning do not reach areas such as seals between inner and outer drive shafts, nor do they reach the annular spaces between inner and outer drive shafts.

According to an aspect of this invention, a sanitary mixer arrangement comprises a vessel with one or more agitators and associated drives. The vessel contains the ingredients that are to be mixed, and has a side wall and a closed top, with the mixer vessel having a vertical axis. In a dual-agitator mixer, an outer or scraper agitator and an inner agitator are driven respectively by an outer vertical tubular drive shaft and inner vertical drive shaft coaxial with the outer drive shaft. The drive shafts penetrate an opening at the closed top of the vessel and descent along the axis of the vessel. An outer seal is positioned at the opening in the closed top of vessel around the outer drive shaft and permitting rotation of the outer drive shaft. A lower drive arrangement rotates the outer drive shaft and is positioned above the closed top of the vessel. An upper drive arrangement drives the inner drive shaft and is positioned above the lower drive arrangement.

The outer drive shaft has an upper terminus beneath the upper drive arrangement. The inner drive shaft extends up above that terminus. The outer drive shaft and said inner drive shaft define an annular space between them that descends down from the terminus and through the closed top of the vessel, with the annular space being open into the interior of the vessel. The inner seal is mounted in said annular space at the terminus of said outer drive shaft, permitting rotation of the inner drive shaft relative to the outer drive shaft.

A central bore is drilled along the axis of the inner drive shaft from an upper end thereof down to a lower end position below the inner seal and above the closed top of the vessel.

A permanent rotary fitting at the upper end of the inner drive shaft permits the introduction of a cleaning fluid under pressure into the central bore. The cleaning fluid passes through the bore and the at least one radial passage into the annular space to clean accumulations from within the annular space and exhaust it into the interior of vessel.

Favorably, the outer agitator has a plurality of scraper vanes that sweep past the interior surface of the vessel side wall.

In a preferred embodiment, the inner drive shaft is solid below the lower end position of said central bore.

Several radial passages extend from the lower end position of the central bore to said annular space, to conduct the fluid from the central bore into the upper end of the annular space. That is, the upper part of the inner shaft is "rifle bored" with an axial passage, and at the bottom end of this passage the shaft is cross-bored so that there is a series of holes to create a rotary spray device with the cross-bored holes being strategically placed to wash the underside of the inner seal and to flush out the annular space.

A rotary union installed at the top end of the inner shaft allow a C.I.P. pipe to be permanently connected, so that the annular space can be flushed, automatically, every time the vessel C.I.P. system is run. The C.I.P. system can be hard-piped to the rotary union, so that the cleaning of the annular space occurs without any operator interaction. This results in the elimination of any cleaning concern about the annular space, and eliminates the potential for carbon dust to build up on the seal faces and fall to into the product over time. This arrangement also allows for service without need for an expensive confined-space entry.

In the described embodiment, the outer drive shaft has at least one cleaning slot extending therethough at a position below the closed top of the vessel and above a lower end of the outer drive shaft. An in-tank spray device within said vessel and near the top or head directs a spray of the C.I.P. fluid towards outer drive shaft to spray cleaning fluid at the cleaning slot or slots. This can provide additional cleaning of the lower part of the annular space and wash out any accumulated carbon or other possible contaminant.

The through-the-shaft-cleaning design can likewise be applied to a single-mixer design where the fluid is supplied into an axial bore in a single drive shaft to clean the shaft seal faces and also to clean the annular space around the shaft where it enters the tank head, especially in those cases where the space is long, e.g., where the tank head is insulated.

As is the conventional practice, the C.I.P. cleaning solution is made up as an aqueous solution of a caustic material, such as potassium hydroxide (KOH). At the end of the caustic phase of the cleaning process, the caustic solution and any entrained solids are discharged to a drain, and the solution is considered waste. A caustic recovery system may fitted to the C.I.P. system.

While the invention has been described with reference to a few selected embodiments, it should be recognized that the invention is not limited to those precise embodiments. Rather, many modifications and variations will be apparent to persons skilled in the art without departing from the scope and spirit of this invention, as defined in the appended claims.

DETAILED DESCRIPTION OF THE PREFERRED EMBODIMENTS

Figure 1:
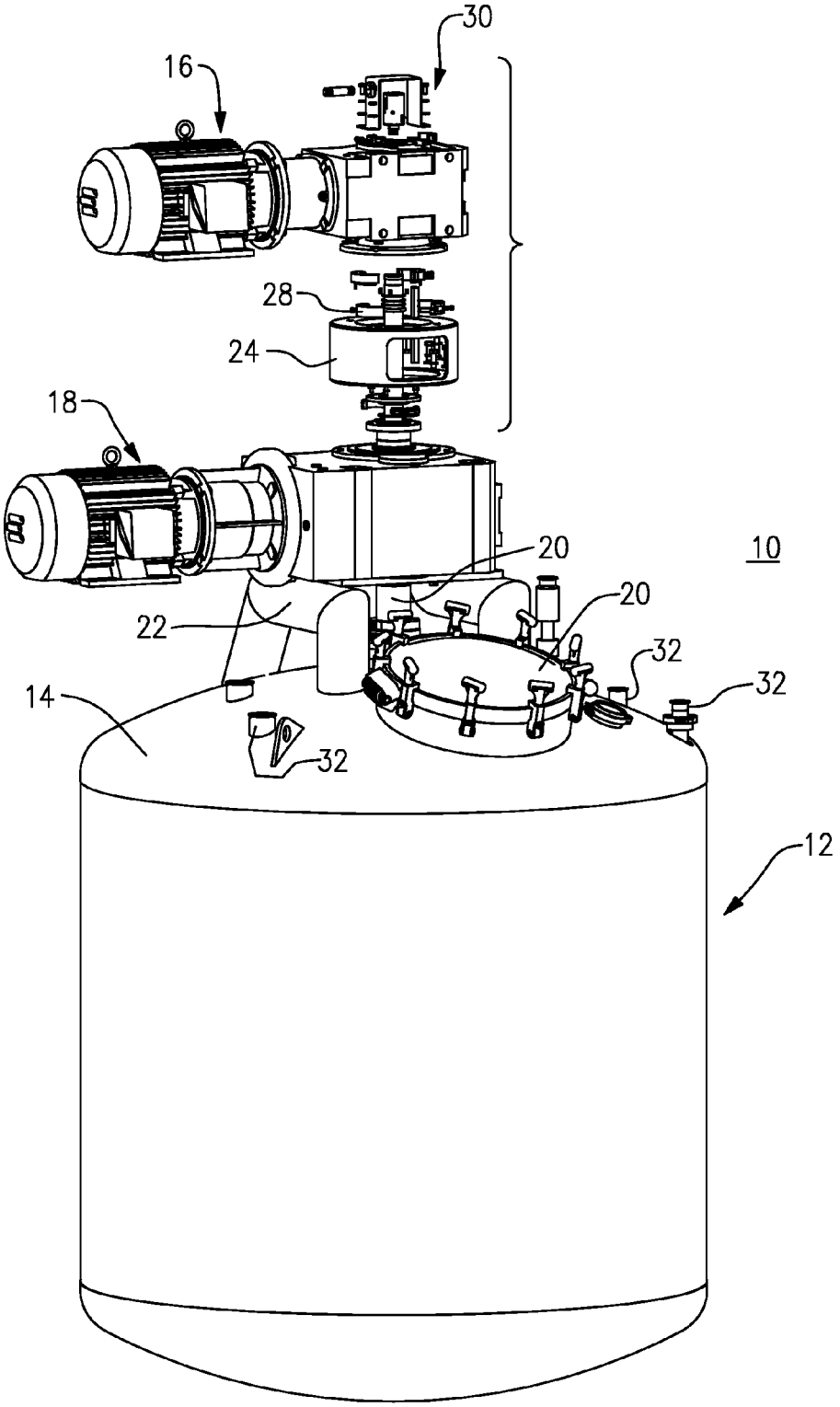
FIG. 1 is an elevation of the mixer and tank or vessel, according to one preferred embodiment of this invention.

With reference to the Drawing, and initially to FIG. 1 thereof, a large industrial mixer 10 has a generally cylindrical tank or vessel 12 formed of stainless steel, with a top or head 14 closing off its upper end. The mixer also has an upper gear motor 16 positioned above a lower gear motor 18, with a inlet/inspection port 20 at one side of the vessel head 14. A support 22 for the lower gear motor 18 is affixed onto the head 14 of the vessel, with the gear motor 18 affixed onto that support 22. A support 24 for the upper gearmotor 16 is secured to a top side of the lower gearmotor 18, with the upper gearmotor 16 being affixed onto the top side of the support 24. A larger diameter hollow outer drive shaft 26 extends up through the drive portion of the gearmotor 18, while a smaller diameter inner drive shaft 28 coaxial with the outer drive shaft 26 passes up through the hollow core of the outer drive shaft 26, then up through the support 24 to the drive portion of the upper gearmotor 16. A rotary union 30 at the top of the upper gearmotor 16 is fitted onto the upper end of the smaller diameter inner drive shaft 28.

A number of clean-in-place inlets 32 are shown installed on the top or head 14 of the tank. There is also a drain and associated valving at the base or lower end of the tank, but that is not shown in this view.

Figure 2:
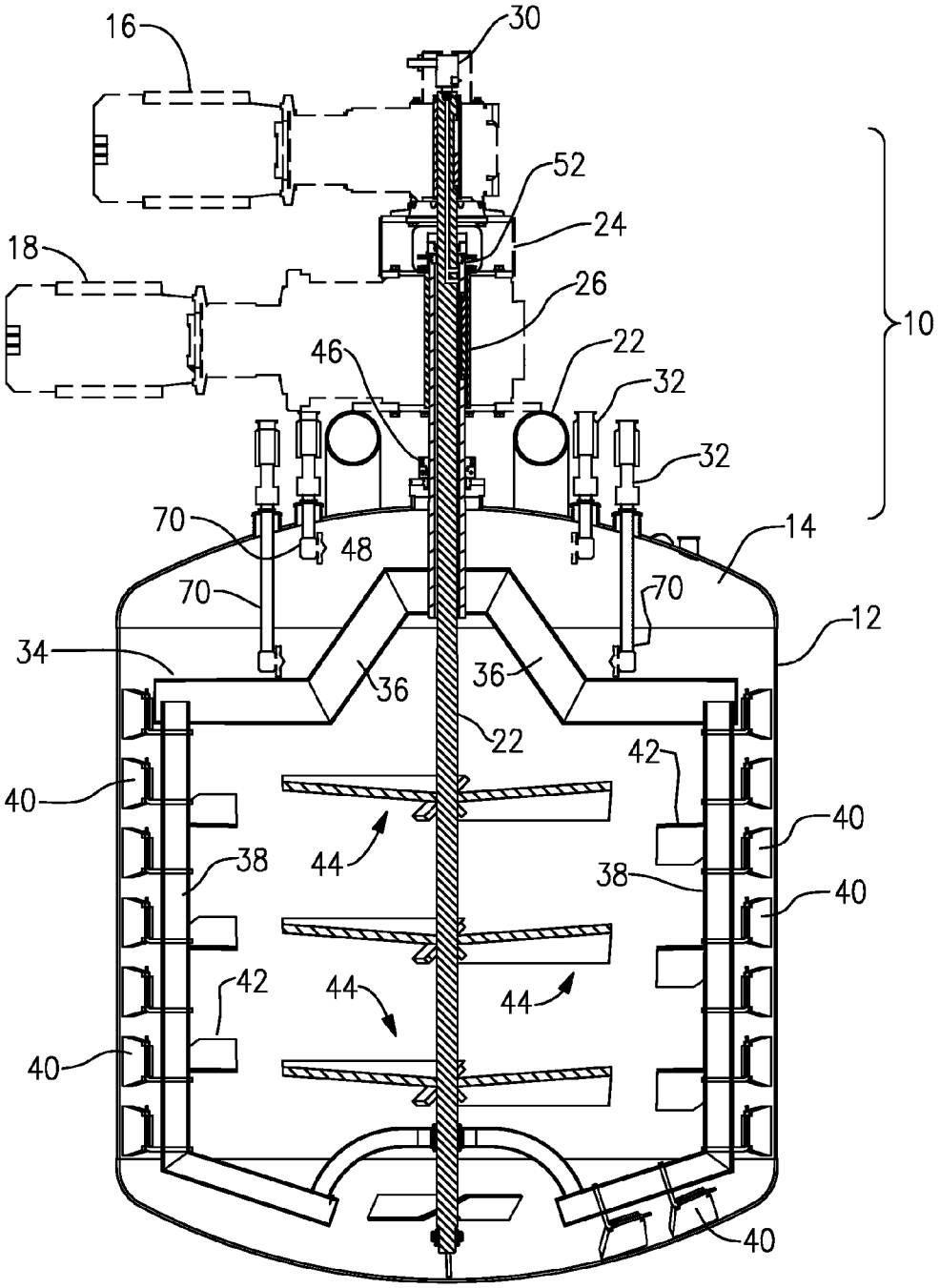
FIG. 2 is a sectional elevation of the mixer.
Figure 3:
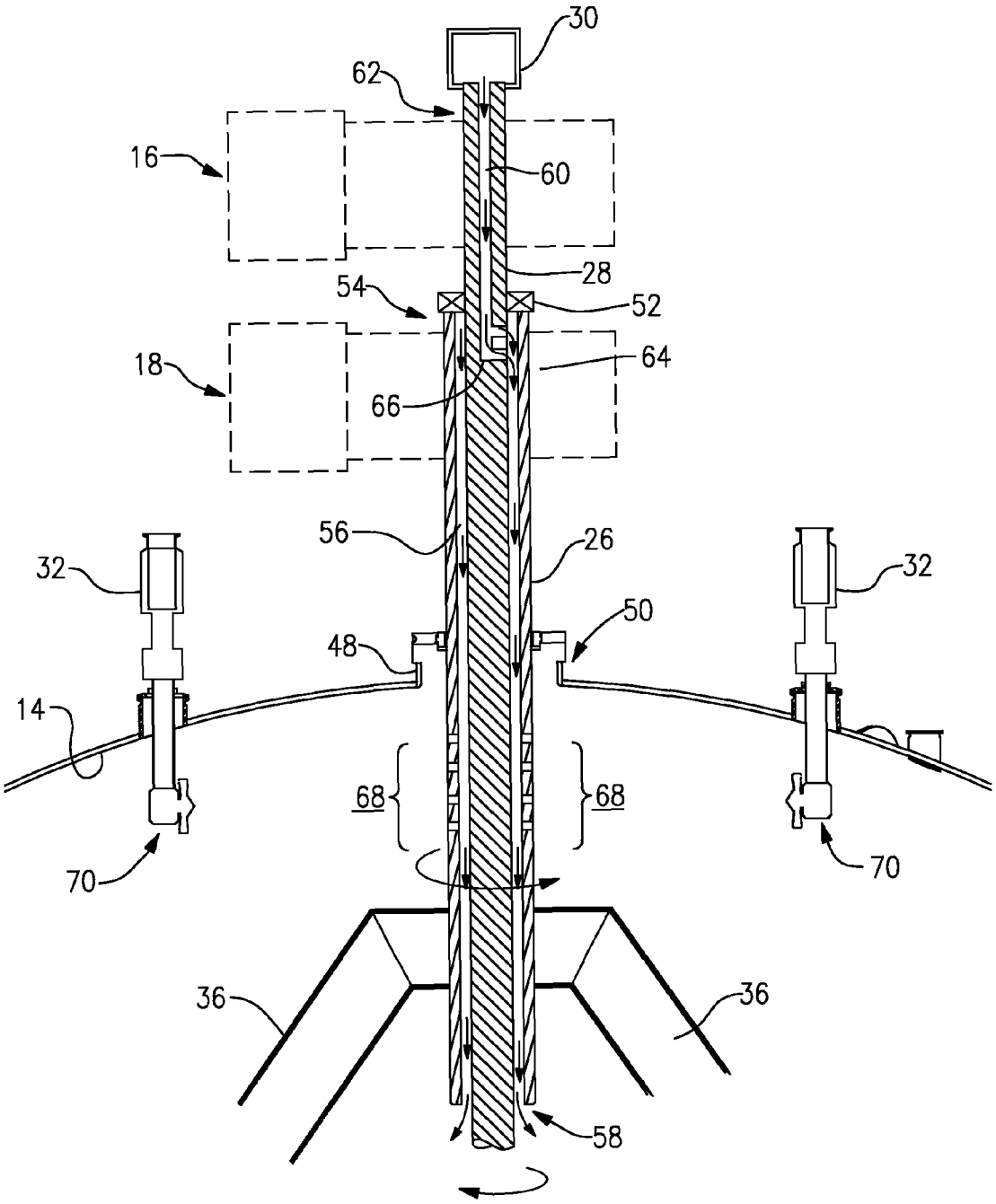
FIG. 3 is a detailed sectional view thereof.

With reference now to FIGS. 2 and 3, on the inside of the tank or vessel 12 here is an outer scraper agitator, which is affixed onto the outer hollow drive shaft 26. The agitator 24 has arms 36 that are welded onto the outer drive shaft 26 and these extend radially to vertical members 38. A suitable number of scraper blades or vanes 40 are affixed onto the radially outer side of the vertical members 38, and there may be additional mixer blades or vanes 42 on the radially inward side of the vertical members. There are also one or more inner agitators 44 attached at one or more locations along the inner drive shaft 28, each of which has a plurality of vanes or blades. In practice the outer scraper agitator 34 and the inner agitators 44 rotate in opposite directions, with the inner agitators operating at a relatively high rotary speed and the outer scraper agitator operating at a much lower rotary speed.

The lower end of the inner drive shaft 28 may be fitted into a rotary support member, in some cases, which would be positioned at or near the center of the base of the vessel or tank 12.

A lower rotary seal 46 is positioned in an associated seal flange 48 that is affixed along the tank axis at a penetration 50 at the center of the top or head 14 of the vessel, through which the coaxial drive shafts 26, 28 pass. This forms a seal where the shaft 26 enters the tank or vessel, i.e., into the space that needs to be clean and sanitary. An upper seal 52 is positioned at a top end 54 of the outer drive shaft 26 where the inner drive shaft 28 exits. There is an annular void or space 56 between the outer and inner drive shafts, extending from the upper end 54 of the outer drive shaft down into the vessel 12 to an open lower end 58 of the drive shaft 26, where the inner drive shaft exits and continues downward. Here the lower end 58 is just below the location where the arms 36 of the outer agitator 34 are affixed onto the drive shaft 26 within the vessel. The upper seal 52 serves to close off the annular space 56 at the top end 54, and permits the inner shaft 28 to rotate relative to the outer shaft 26.

The upper portion of the inner drive shaft 28 is here configured as a through-the-shaft cleaning design, for cleaning the lower surface of the upper seal 56 as well as the surfaces of the outer and inner drive shafts that define the annular space 56. Here an axial bore 60 extends from a top end 62 of the drive shaft 28 to a point 64 that is just below the location of the upper seal 52. One or more cross-bore passages 66 extend radially outward from the axial bore 60 to the annular space 56. The upper end of the bore 60 communicates with the rotary union 30 and piping is connected to the union 30 to supply a cleaning fluid, e.g., a caustic solution, and a subsequent water flush, and optionally sterilizing steam, into the annular space 56 between the drive shafts. This serves to clean and flush the entire length of the space 56, and with the solution exiting out the open lower end 58 of the outer drive shaft. The cross-bore passages 66 act as a rotary sprayer, to remove any accumulations, including carbon particles, from the lower surface of the seal 52.

The through-the-shaft cleaning system achieves a much higher degree of cleanliness than when the in-tank cleaning devices alone are used.

As shown in FIG. 3, there are perforations or openings 68 in the side wall of the outer drive shaft 26 at an intermediate position between the outer seal 46 and the agitator arms 36. C.I.P. spray heads 70 are also present in the vessel 12, each descending from an associated one of the C.I.P. inlets on the tank head 14. One or more of these spray heads 70 are directed toward the location of these perforations or openings 68. Thus, with this feature, during a C.I.P. cleaning operation, the C.I.P. solution enters through the openings 68 into the lower part of the annular void 56, and then flushes out through the open lower end 58 of the shaft 26. This ensures that there is additional flushing and cleaning of the lower end of the annular space, where accumulations are more likely to be present after a mixing operation.

In extremely sterile applications, this design permits use of live steam, either in lieu of cleaning solutions or subsequent to their use, for sterilizing these difficult-to-reach areas.

The tank 12 for this mixer arrangement may have a different design, with outer and inner agitators of any of a number of constructions, depending upon the mixer application.

Figure 4:
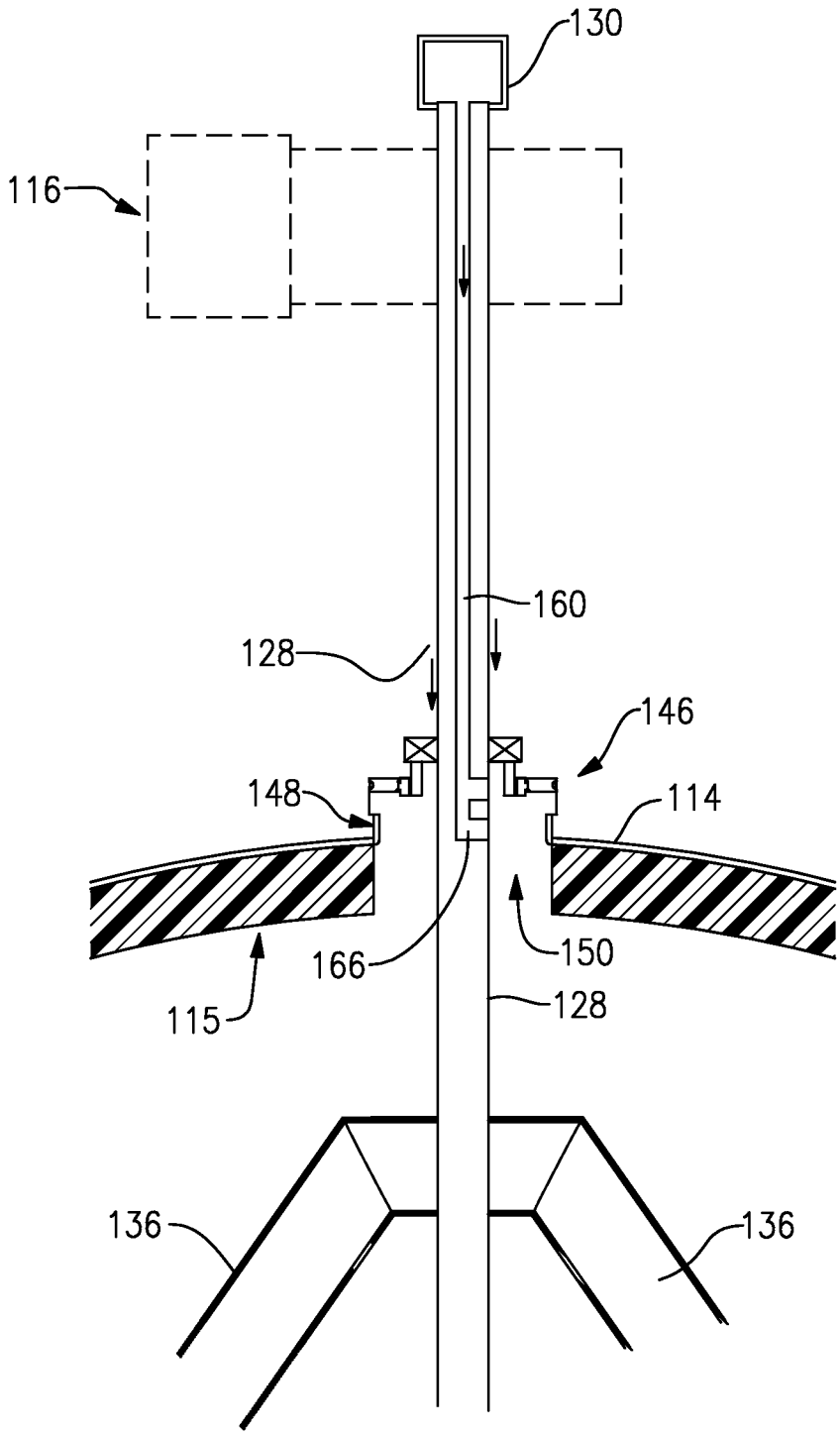
FIG. 4 is a partial sectional view of a single-shaft embodiment.

Of course, the same principles as discussed above may be used for through-shaft cleaning of single-shaft mixers as well, as illustrated in FIG. 4. Here elements that correspond to features of the previously-described embodiment are identified with the same reference numbers, where possible, but raised by 100. In tanks of the single-mixer design, it as always been a problem to clean the deep annular space 150 defined around the shaft 128 beneath the shaft seal 146 and around the supporting seal flange 148, especially in the tanks where the tank head 114 includes a thickness of insulation 115.

As in the previously-described embodiment, the shaft 128 is driven by a gearmotor 116 that is supported above the tank head, and has a rotary union 130 at its upper end to receive the C.I.P. fluid. Agitator arms 136 are shown here mounted on the rotary drive shaft 128. The upper end of the shaft 128 has an axial bore 160 ending in one or more cross bores 166, which allow the C.I.P. fluid to be sprayed onto the underside of the seal 146 and on the inner surfaces of the seal flange 148 and also to flood the deep annular space 150 between the shaft 128 an the insulation covering, with the fluid then draining out of the annular space into the tank.

While the invention has been explained with reference to a preferred embodiment, it should be understood that the invention is not limited to that precise embodiment. Rather many modifications and variations will present themselves to persons of skill in the art without departing from the scope and spirit of the invention, as defined in the appended claims.

What is claimed is:

1. A sanitary mixer arrangement comprising a vessel for containing ingredients as they are mixed, and having a side wall, a closed top, and the mixer vessel having a vertical axis;

an outer agitator and an inner agitator disposed within said vessel, and driven respectively by an outer vertical tubular drive shaft and an inner vertical drive shaft coaxial with said outer drive shaft, the drive shafts penetrating an opening at the closed top of the vessel and extending along the axis thereof into the vessel;

an outer shaft seal positioned at said opening in the closed top of said vessel around said outer drive shaft and permitting rotation thereof;

a lower drive arrangement for rotating said outer drive shaft and being positioned above the closed top of the vessel;

an upper drive arrangement for rotating said inner drive shaft and being positioned above the lower drive arrangement;

said outer drive shaft having an upper terminus below said upper drive arrangement, and the inner drive shaft extending up above said terminus;

said outer drive shaft and said inner drive shaft defining an annular space therebetween that descends from said terminus and through the closed top of the vessel, the annular space being open into the interior of the vessel;

an inner shaft seal mounted in said annular space at the terminus of said outer drive shaft and permitting rotation of said inner drive shaft relative to said outer drive shaft, the annular space between said inner and outer drive shafts being free of other seals beneath said inner shaft seal such that the annular space downward from said inner shaft seal is open into the interior of the vessel;

an axial bore extending axially in the inner drive shaft from an upper end thereof down to and terminating at a lower end position below the inner shaft seal and above the closed top of said vessel, with at least one radial passage at said lower end position and open to the annular space between said outer and inner drive shafts; and means at the upper end of said inner drive shaft for introducing a cleaning fluid under pressure into said axial bore to pass through said bore and said at least one radial passage and thence into said annular space to clean accumulations from within said annular space and exhaust said accumulations into the interior of said vessel.

2. The mixer arrangement according to claim 1 wherein said outer agitator includes a plurality of scraper vanes that sweep past an interior surface of the vessel.

3. The mixer arrangement according to claim 1 wherein said inner drive shaft is solid below the lower end position of said axial bore.

4. The mixer arrangement according to claim 1 wherein a plurality of radial passages extend from the lower end position of the axial bore to said annular space, to permit cleaning of a surface of said inner shaft seal.

5. The mixer arrangement according to claim 1 wherein said outer drive shaft has at least one cleaning slot extending therethough at a position below the closed top of the vessel and above a lower end of the outer drive shaft.

6. The mixer arrangement according to Claim 5 further comprising at least one in-tank spray device positioned within said vessel and directed towards said outer drive shaft to spray cleaning fluid at the at least one cleaning slot.

7. A sanitary mixer arrangement comprising a vessel for containing ingredients as they are mixed, and having a side wall, a closed top, and the mixer vessel having a vertical axis;

an agitator disposed within said vessel, and driven by a vertical drive shaft, the drive shaft penetrating an opening at the closed top of the vessel and extending along the axis thereof into the vessel, with a generally cylindrical portion of the vessel at the closed top of the vessel surrounding said drive shaft and defining an annular space around said drive shaft which is open at its lower end into the interior of the vessel;

a shaft seal positioned at said opening in the closed top of said vessel at an upper portion of said cylindrical portion, and disposed around said drive shaft and permitting rotation thereof;

a drive arrangement for rotating said drive shaft and being positioned above the closed top of the vessel;

an axial bore extending axially in the drive shaft from an upper end thereof down to and terminating at a lower end position below the shaft seal adjacent the closed top of said vessel within said cylindrical portion, with at least one radial passage at said lower end position and open to said annular space defined around said drive shaft, and said annular space being free of seals below said shaft seal to said lower end thereof which is open into the interior of said vessel; and means at the upper end of said drive shaft for introducing a cleaning fluid under pressure into said axial bore to pass through said bore and said at least one radial passage and thence into said annular space to clean accumulations from within said annular space and exhaust said accumulations into the interior of said vessel.

8. The mixer arrangement according to claim 7 wherein said drive shaft is solid below the lower end position of said axial bore.

9. The mixer arrangement according to claim 7 wherein a plurality of radial passages extend from the axial bore above the lower end position of the axial bore to said annular space, with at least one of said radial passages being configured to permit cleaning of a surface of said shaft seal.

10. The mixer arrangement according to claim 7 wherein said axial bore is disposed centrally in said shaft.

11. The mixer arrangement according to claim 6 wherein the at least one cleaning slot in said outer drive shaft includes plurality of openings penetrating through the outer drive shaft to the annular space between the outer drive shaft and the inner drive shaft.

12. The mixer arrangement according to claim 7 wherein the closed top of the vessel includes a thickness of insulation, with said generally cylindrical portion being formed in said thickness of insulation, and with the annular space being defined between said thickness of insulation and said vertical drive shaft.

* * * * *